US005445101A

United States Patent [19]

Koch

[11] Patent Number: 5,445,101

[45] Date of Patent: Aug. 29, 1995

[54] SYSTEM FOR SPRAY WASHING BOAT HULLS

[76] Inventor: Leonard Koch, 226 3rd St., Apt. 111, Bonita Springs, Fla. 33923

[21] Appl. No.: 242,777

[22] Filed: May 16, 1994

[51] Int. Cl.[6] ..... B63B 59/00

[52] U.S. Cl. ..... 114/222; 114/48

[58] Field of Search ..... 114/48, 51, 222; 405/3-7; 187/8.59; 15/1.7

[56] References Cited

U.S. PATENT DOCUMENTS

| | | | |
|---|---|---|---|
| 4,007,701 | 2/1977 | Fike | 114/222 |
| 4,030,440 | 6/1977 | Wickersham | 114/222 |
| 4,204,494 | 5/1980 | Bridwell et al. | 114/222 |

*Primary Examiner*—Stephen Avila
*Attorney, Agent, or Firm*—William E. Noonan

[57] ABSTRACT

A boat washing system is provided for use with a boat lift having a frame for supporting an boat and a drive mechanism for selectively raising the frame to lift the boat from the water and lowering the frame to lower the boat into the water. The washing system includes a sprayer assembly having a plurality of spray nozzles. The sprayer assembly is communicably connected to a source of water under pressure. The sprayer assembly is mounted to the frame of the boat lift such that the spray nozzles are directed at the hull of the boat supported on the frame. Water is introduced into the sprayer assembly and directed through the spray nozzles at the hull of the boat.

20 Claims, 3 Drawing Sheets

10
12
15
28
30
32
34
36
60
62
64
66
68
70
72
74
76
80
82
86
88
90
92
94
96
98
100
102
104
106
108
110
112
114
116
118
120
122
152
154
156
158
160
162
164
170
172
174
176
196
3

SYSTEM FOR SPRAY WASHING BOAT HULLS

FIELD OF THE INVENTION

This invention relates to a boat washing system for use with a conventional boat lift, and more particularly, to a sprayer apparatus that is integrated with a boat lift for washing a double hulled vessel, such as a pontoon boat.

BACKGROUND OF THE INVENTION

Each time a boat is used, its hull tends to collect all sorts of debris, including vegetation, sand, dirt, salt, barnacles, mildew, etc. Boat hulls become particularly dirty after extended periods below the water line. When left unattended, a dirty boat hull can prematurely deteriorate and adversely affect the performance and appearance of the boat.

To preserve the boat's hull and facilitate cleaning of the hull, a variety of boat lifts have been developed so that the boat can be periodically raised out of the water. To date, however, a quick, convenient and efficient system for washing boat hulls has not been developed. Typically, the boat owner must use brushes and hoses to manually clean the vessel. This is obviously a strenuous and time consuming task. Automatic systems that have been developed are usually quite complex and expensive and are just not practical for the small boat owner. Moreover, no adequate washing system is available for use with a conventional boat lift. A particular need exists for a boat washing system that can be used for pontoon boats and other double hulled vessels.

SUMMARY OF INVENTION

It is therefore an object of this invention to provide a boat washing system that is integrated into and operable with a conventional boat lift.

It is a further object of this invention to provide a boat washing system that significantly reduces the time and effort involved in cleaning a boat's hull.

It is a further object of this invention to provide a boat washing system that quickly and efficiency cleans a boat's hull so that the boat's life is extended and its performance and appearance are improved.

It is a further object of this invention to provide a boat washing system that is particularly useful for pontoon boats and other double hulled vessels.

It is a further object of this invention to provide a boat washing system that is quick and relatively inexpensive to integrate into virtually all boat lifts and which is therefore particularly attractive for use by small boat owners.

This invention features a boat washing system for use with a boat lift having a frame for supporting a boat and a means for selectively raising the frame to lift the boat from the water and lowering the frame to lower the boat into the water. The washing system includes a sprayer assembly having a plurality of spray nozzles. There are means for communicably connecting the sprayer assembly to a source of water under pressure. Means are also provided for mounting the sprayer assembly to the frame of the boat lift such that the spray nozzles are directed at the hull of the boat supported on the frame. Water is introduced into the sprayer assembly and directed through the spray nozzles at the hull of the boat.

In a preferred embodiment, the sprayer assembly includes an elongate section of pipe and the spray nozzles comprise a series of holes formed in the pipe. The sprayer assembly may include a pair of generally parallel longitudinal less and a transverse section interconnecting the legs. Each of the less includes a plurality of spray nozzles. The means for mounting may include means for fastening the less directly to the frame. Such means for fastening may include at least one transverse bracket that interconnects each of the less and the frame. The means for mounting may further include means for securing the transverse section of the sprayer assembly directly to the frame. Such means for securing may include at least one longitudinal brace that interconnects the transverse section and the frame.

The means for connecting preferably include a flexible hose segment that interconnects the water source and the transverse section. The means for connecting may further include valve means for selectively restricting water under pressure from entering the sprayer assembly.

At least one guide device is preferably attached to and extends upwardly from the frame laterally outside of the leg segments for guiding the boat onto the frame such that the hull is generally centered between the leg segments of the sprayer assembly. In each guide device a generally cylindrical guide element may be rotatably and slidably mounted to a respective pole.

The system may be particularly advantageously employed on a boat lift for a double hulled vessel, such as pontoon boat. In such cases, the frame includes a pair of longitudinal members for supporting respective hulls of the boat and at least one transverse member interconnecting the longitudinal members. In this embodiment, the system includes a pair of sprayer assemblies. Each assembly is associated with a respective one of the hulls of the boat and has a plurality of spray nozzles. Each sprayer assembly is constructed analogous to the sprayer assembly in the previously described embodiment.

DETAILED DESCRIPTION OF PREFERRED EMBODIMENTS

Other objects, features and advantages will occur from the following, description of preferred embodiments and the accompanying drawings, in which.

Figure 1:
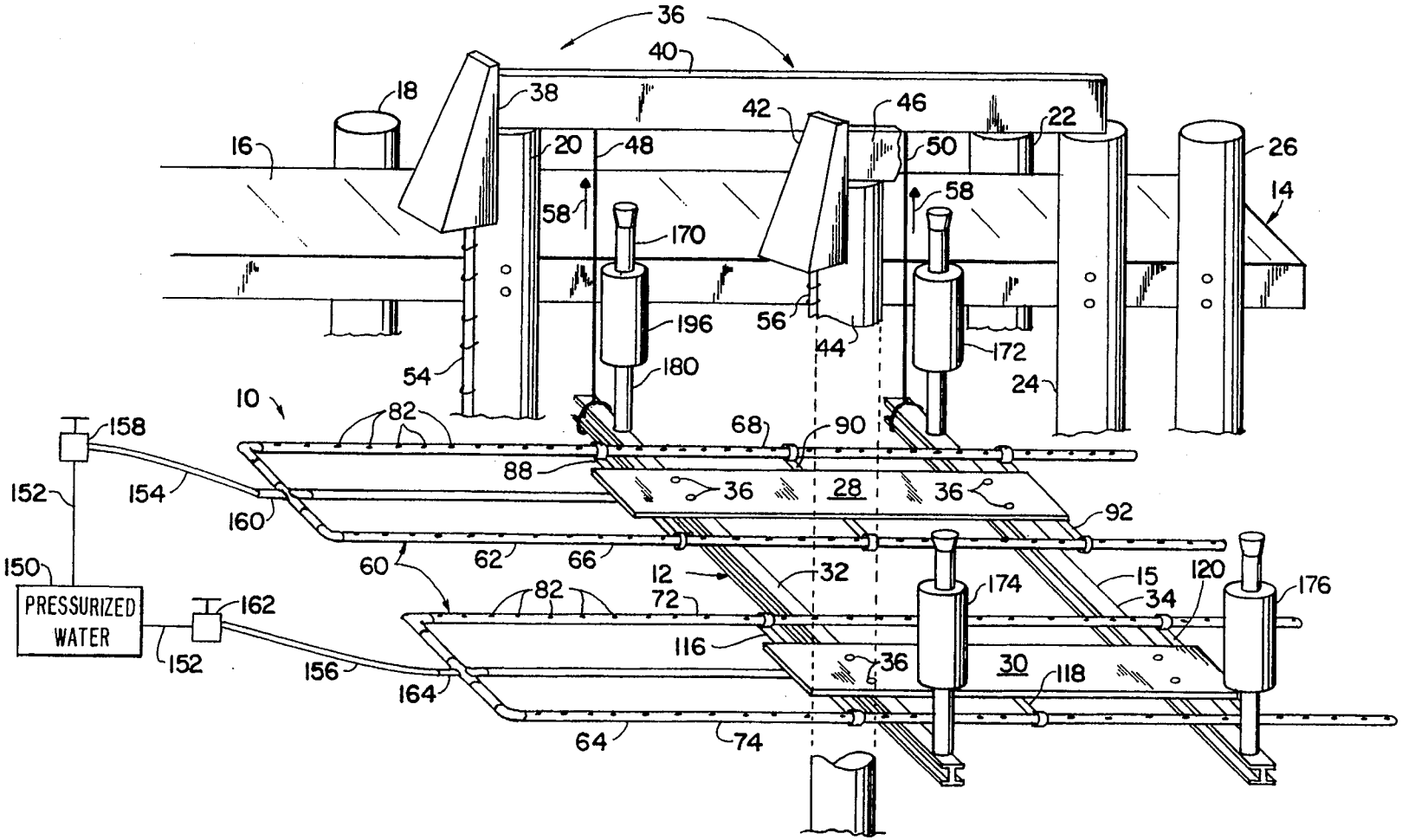
FIG. 1 is a partly perspective, partly schematic and partly cut away view of the boat washing system of this invention.

There is shown in FIG. 1 a boat washing system 10 that is used in connection with a pontoon boat lift 12. The boat washing system of this invention may be used with various types of boat lifts in addition to the double hulled lift that is disclosed herein. Nonetheless, system 10 is particularly effective for use with pontoon boats or other double hulled vessels.

Boat lift 12 is mounted adjacent to a boat dock 14. The dock includes a walkway 16 that is supported in a conventional manner by a plurality of pilings 18, 20 22, 24 and 26. Boat lift 12 includes a frame 15, also shown in FIGS. 2 and 3, that is disposed in a lowered position, just below the water line. Frame 15 is selectively raised to lift a double hulled vessel in the manner described more fully below. The frame includes a pair of longitudinal plank members 28 and 30 that are spaced apart and arranged substantially parallel to the walkway 16 of dock 14. A pair of transverse members 32 and 34 interconnect plank members 28 and 30 and are secured to the plank members by appropriate bolts 36. Transverse members 32 and 34 preferably comprise an I-beam or an analogous element composed of a durable metal or synthetic material.

Boat dock 14 and boat lift 12 are conventional items that are already widely used for accessing and lifting docked vessels. The frame 15 of boat lift 12 is selectively raised and lowered by a conventional mechanism 36. This mechanism comprises a first drive motor 38 that is mounted in a known manner to piling 20. An elongate cable housing 40 extends from drive motor 38 and is carried by pilings 20 and 24. A similar, second drive motor 42 is mounted to the upper end of a piling 44 that is disposed on the opposite side of boat lift 12. An intermediate section of piling 44 is omitted in FIG. 1 to provide a clear view of boat lift 12 and washing system 10. A second elongate cable housing 46, only a portion of which is shown, is operably connected to drive motor 42 and extends between piling 44 and a second piling (again omitted for clarity), which is proximate the distal, right-hand end of boat lift 12.

Cables 48 and 50 are operably connected to drive motor 38 and extend downwardly from housing 14. The lower end of cables 48 and 50 are tied, bolted, hooked or otherwise secured in a known manner to transverse members 32 and 34, respectively, of frame 15. Similar cables, not shown, are likewise operably connected to drive motor 42 and depend from cable housing 46 such that they attach to the opposite ends of transverse elements 32 and 34. These are the ends proximate the observer in FIG. 1.

Drive motors 38 and 42 are energized by waterproof cables 54 and 56 that are connected to a source of power in a known manner. As a result, boat lift 12 is operated in a standard fashion to raise and lower a double hulled vessel for storage or cleaning. In particular, to raise a pontoon boat or other double hulled vessel, first the boat is positioned over frame 12. The frame is disposed just below the water line so that the boat is readily positioned over the frame without interference. Typically, one hull of the vessel is positioned above and substantially aligned with plank member 28. The other hull is positioned over and substantially aligned with plank 30. Drive motors 38 and 42 are then operated in a known manner so that cables 48 and 50 (and the omitted cables depending from housing 46) are raised in the direction of arrows 58. As a result, plank members 28 and 30 engage the boat hulls and the entire boat is lifted upwardly to a desired level, such as that shown in FIG. 6. Subsequently, to redeploy the boat, drive motors 38 and 42 are reversed such that cables 48 and 50 (and the analogous cables extending between housing 46 and the opposite ends of members 32 and 34), are lowered until the boat floats in the water.

Figures 2, 3, 4:
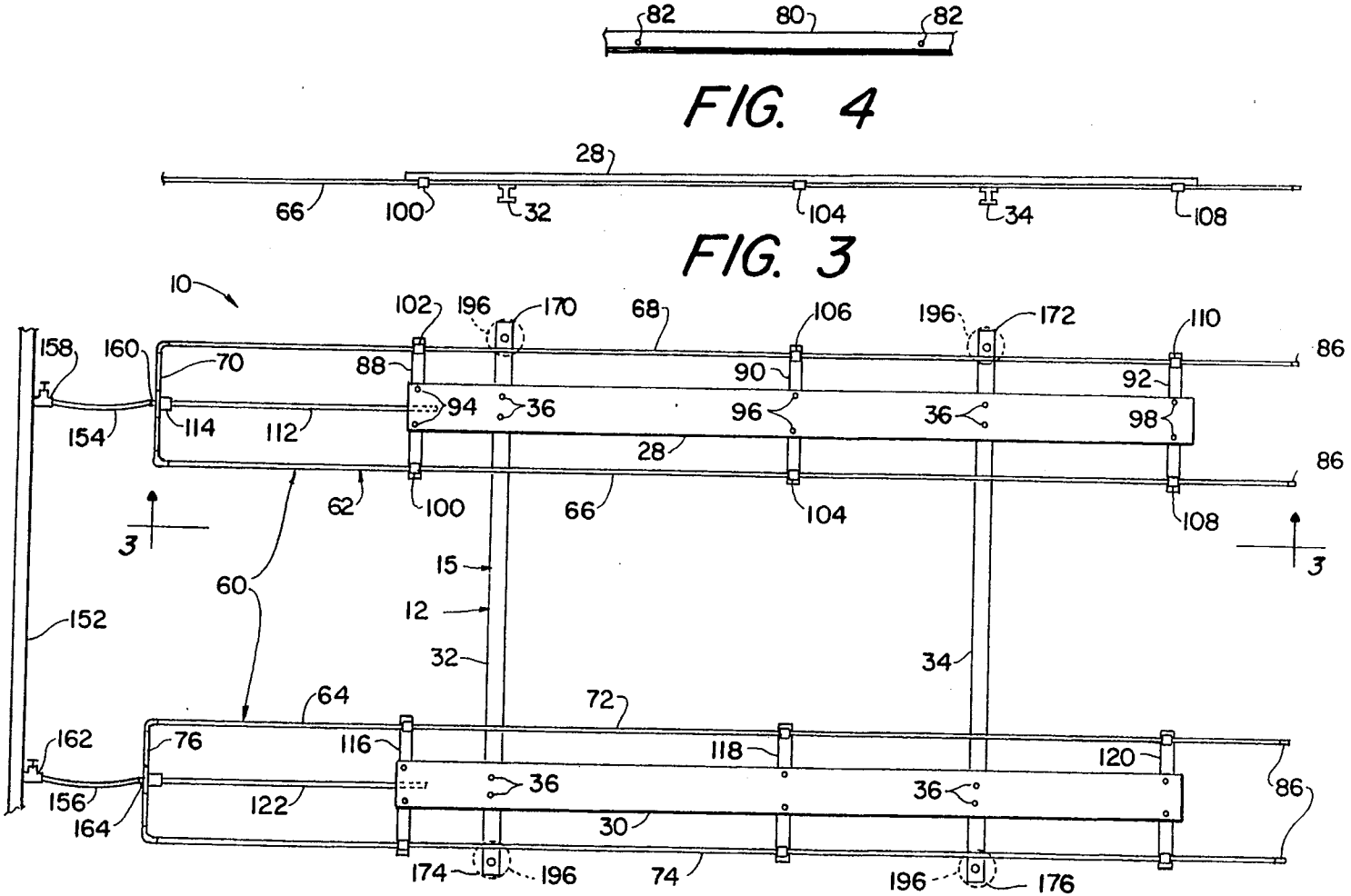
FIG. 2 is a plan view of the boat washing system.
FIG. 3 is an elevational side view taken along line 3—3 of FIG. 2.
FIG. 4 is an elevational view of a section of pipe forming the sprayer assembly.

Washing system 10 is integrated with boat lift 12 in the manner shown in FIGS. 1 and 2. The washing system 10 includes a sprayer apparatus 60 comprising a first sprayer assembly 62 and a second sprayer assembly 64. Each sprayer assembly generally forms a "U" shape. Sprayer assembly 62 includes a first inner longitudinal leg section 66, a second outer longitudinal leg section 68 that is parallel to leg 66 and a transverse section 70 that communicably interconnects legs 66 and 68 and is attached at generally a perpendicular angle to each of the legs. Sprayer assembly 64 likewise includes an inner leg section 72 and a parallel outer leg section 74. A transverse section 76 is again communicably interconnected between sections 72 and 74. Each of the legs 72 and 74 extends at a perpendicular angle from section 76.

As best illustrated in FIG. 4, each sprayer assembly comprises an elongate piece of pipe 80. Pipe 80 may be constructed of PVC or other durable, yet corrosion resistant materials. As best shown in FIG. 2, the distal or rearward ends of leg sections 66, 68, 72 and 74 are sealed closed by a suitable caps 86. A series of spray nozzles 82, FIGS. 1 and 4, are formed in each sprayer assembly along the entire length of the pipe. Preferably these nozzles are simply holes or openings in the pipe, which have a diameter that permits water under pressure to be sprayed from the pipe. The nozzles are formed at an angle that directs water toward the hull of a boat mounted on frame 15.

Sprayer assemblies 62 and 64 are mounted to respective sides of boat lift frame 15. In particular, there are three transverse metal or plastic brackets 88, 90 and 92 for fastening legs 66 and 68 to plank member 28. Each of the brackets 88, 90 and 92 extends beneath plank member 28 and is secured thereto by a respective pair of bolts or screws 94, 96, and 98 (FIG. 2). Bracket 88 carries at its opposite ends a pair of sleeves 100 and 102 that accommodate legs 66 and 68, respectively. Similarly, bracket 90 carries a pair of sleeves 104 and 106 that receive legs 66 and 68, respectively. Bracket 92 likewise includes sleeves 108 and 110 for receiving the legs of sprayer assembly 62. A longitudinal brace 112 secures transverse section 70 of assembly 62 to the bottom surface of plank member 28. Brace 112 comprises a flat piece of metal or plastic that is secured to the plank member by an appropriate bolt or screw. The opposite end of brace 112 includes a sleeve or clip 114 that engages transverse section 70.

Sprayer assembly 64 is similarly constructed. A trio of transverse brackets 116, 118 and 120 are secured to the bottom surface of plank member 30 by appropriate bolts or screws. Each of the brackets includes, at its respective ends, a pair of sleeves that accommodate respective legs 72 and 74 of assembly 64. A metallic brace 122, analogous to brace 112, interconnects transverse section 76 and the lower surface of plank member 30.

The above construction securely fastens sprayer assemblies 62 and 64 to boat lift frame 15. Laterally and longitudinal movement of the sprayer assemblies is restricted and the sprayer assemblies are positioned along the longitudinal plank members 28 and 30 such that their spray nozzles 82, FIG. 4, are pointed at the sides of a boat hull. This orientation and the operation of the spray nozzles are explained more fully below.

As shown in FIG. 1, a source of pressurized water 150 is interconnected to sprayer assemblies 62 and 64. In particular, as further shown in FIG. 2, a conventional conduit 152 transmits water in the vicinity of the boat lift. This is a standard conduit that is used to provide fresh water under pressure to the various slips in the marina. A first flexible hose section 154 interconnects sprayer assembly 62 to conduit 152 and a similar hose segment 156 joins sprayer assembly 64 to the water conduit. One end of hose 154 is connected to conduit 152 through a valve 158. The opposite end of the hose is communicably attached to transverse section 70 of sprayer assembly 62 by a fitting 160. Similarly, hose 156 is interconnected by a valve 162 to conduit 152 and by a fitting 164 to transverse section 76 of sprayer assembly 64. Valves 158 and 162 are selectively opened to introduce water under pressure into sprayer assemblies 62 and 64, respectively. When pressurized water is introduced in this manner into the spray assemblies, it is sprayed outwardly through nozzles 82 toward the boat hulls that are mounted on the boat lift frame.

FIGS. 1 and 2 also disclose a plurality of guide devices for centering a boat on the boat lift so that the boat hulls are positioned for proper cleaning by the cleaning system. A first guide device 170 is mounted to transverse element 32 proximate one end of element 32 at a location outside of sprayer apparatus 60. A second guide device 172 is similarly mounted to transverse frame element 34 laterally outside of sprayer assembly 62. Analogous guide devices 174 and 176 are mounted to the opposite ends of transverse elements 32 and 34, respectively.

Figure 5:
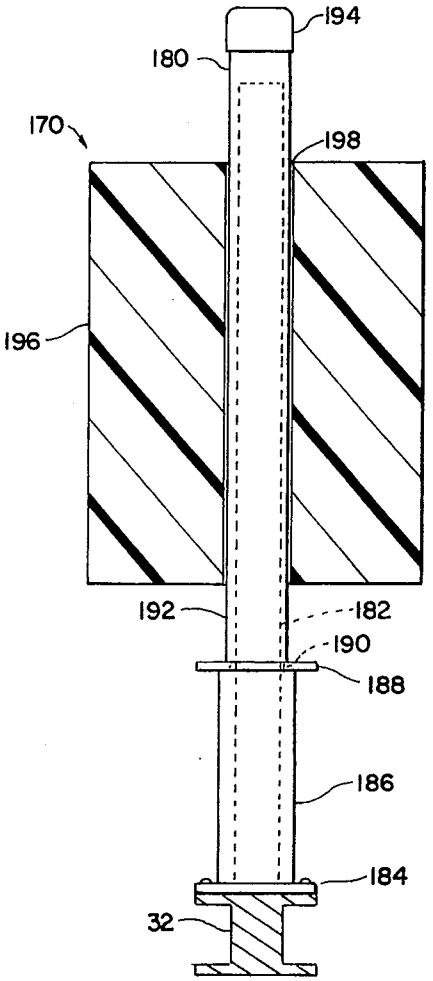
FIG. 5 is a cross sectional view of one manner of constructing the guide mechanism of this invention.

A single guide device 170, which is representative of each of the four guide devices, is shown in FIG. 5. Guide device 170 includes an elongate post 180 that is secured to and extends vertically upwardly from transverse element 32. In particular, post 180 comprises an inner shaft 182 that is composed of galvanized steel. Shaft 182 extends upwardly from a galvanized flange or base 184 that is bolted, welded or otherwise secured to the upper surface of transverse frame element 32. An outer sleeve of galvanized metal 186 is disposed about the lower end of shaft 182 and is secured to or loosely mounted on base 184. A flat washer 188 is supported on the upper edge of sleeve 186. Washer 188 includes a central opening 190 through which shaft 182 extends. A pipe segment 192, which is composed typically of PVC plastic, is fitted over shaft 182 and rests on the upper surface of washer 188. A cap 194 is attached to the top of pipe segment 192.

A guide element 196 (also shown in phantom in FIG. 2) is rotatably and slidably mounted on post 180. In particular, guide element 196 has a generally cylindrical shape with a central axial opening 198 that receives post 180. There is sufficient clearance between the inner diameter of the guide element and the outer diameter of post 180 such that the guide element 196 is rotatable about and slidable along post 180. As a result, the four guide devices 170, 172, 174 and 176 permit a boat to be centered on the boat lift so that proper washing is achieved. Guide element 196 is preferably composed of material such as PVC plastic that does not harm the boat when the boat strikes the guide device. Guide element 196 is rotatable so that friction against and scratching of the boat are further reduced. Normally, guide element 196 is composed of buoyant material such that it floats upwardly as the boat lift and the guide devices are submerged. Damageless guidance and centering of the boat are thereby achieved even when the boat lift is in its lowered condition.

Figure 6:
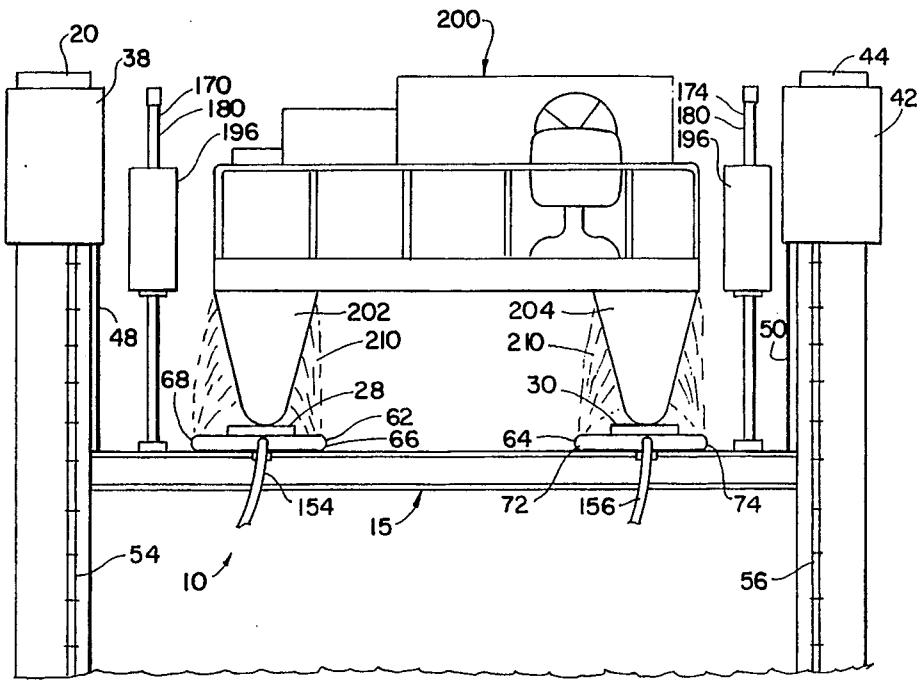
FIG. 6 is an elevational end view of the boat washing system in operation. A pontoon boat is mounted on the boat lift and the boat lift is in a raised condition.

The boat washing system is shown in operation in FIG. 6. Therein, a pontoon boat 200 is mounted on raised boat lift frame 15. Boat 200 is initially positioned on frame 15 when the frame is in the lowered condition shown in FIG. 1. The boat is maneuvered between the pilings on either side of frame 15. In FIG. 6, only pilings 20 and 44 are apparent on either side of frame 15. Boat 200 is maneuvered to position hulls 202 and 204 over the submerged frame 15. Hull 202 is aligned with and positioned above plank member 28 and hull 204 is disposed above and aligned with plank member 30. Guide devices 170, 172, 174 and 176, FIG. 1, center boat 200 such that the hulls 202 and 204 are properly positioned over the plank members. The cylindrical guide members 196 rotate so that the sides of the pontoon boat are not scuffed. Drive motors 38 and 42 are then operated as described above to lift frame 15 and raise boat 200 into the position shown in FIG. 6.

With boat 200 in the raised condition, valves 158 and 162, FIGS. 1 and 2, are opened. Pressurized water is provided through hoses 154 and 156 to sprayer assemblies 62 and 64. Accordingly, as shown in FIG. 6, water 210 is sprayed through the nozzles in the spray assemblies 62 and 64 toward respective boat hulls 202 and 204. In particular, the nozzles along leg 66 direct water 210 against the inside surface of hull 202 and the orifices in leg 68 direct water against the outside surface of hull 202. Similarly, the orifices along leg 72 direct water against the inside surface of hull 204 and the orifices of leg 74 spray water against the outside surface of hull 204. While water is being sprayed in this manner, the boat owner can sponge, scrub and otherwise wash the surfaces of the boat hull to remove dirt, salt and underwater plant growth and debris from the vessel. When the cleaning of either hull is complete, the sprayer assembly 62, 64 that is associated with that hull may be shut off simply by closing that sprayer assembly's valve 158, 162.

After cleaning of the boat is completed, both valves 158 and 162 are closed. The boat 200 remains on lift 12 until subsequent use of the vessel is desired. The boat lift then lowers boat 200 into the water, in a known manner, and the boat may be redeployed. Guide devices 172–176 again allow the boat to leave the slip with a minimum of damage. Repeated raising and lowering of the boat lift does not adversely affect system 10. Because the hoses 154 and 156 are flexible they may be repeatedly raised and lowered and they are able to conform to various orientations and sizes of boat lifts. Also, the PVC pipe segments of the sprayer assemblies resist corrosion.

Accordingly, the present invention provides a quick and convenient system for spray washing the hull of a boat. A dual sprayer assembly is particularly effective for use with double hulled vessels such as pontoon boats. A durable and yet light weight mounting system is used to secure the sprayer assemblies to a conventional boat lift. The mounting elements, including the braces and brackets, permit the spray washing system 10 to remain securely mounted to the boat lift for an extended period of time without requiring repair or replacement. Although the above drawings disclose the apparatus for use with the cleaning system mounted to a double hulled boat lift, it should be understood that the invention also may be employed for single hull boats. In such cases a single spray assembly as described above, is mounted to the boat lift such that each leg section of the assembly extends along one side of the single hull.

Although specific features of the invention are shown in some drawings and not others, this is for convenience only, as each feature may be combined with any or all of the other feature in accordance with the invention. Other embodiments will occur to those skilled in the art and are within the following claims.

What is claimed is:

1. A system for lifting and washing a boat that is docked in a body of water, said system comprising:

a boat supporting frame disposed beneath a hull of the docked boat;

means for selectively raising the entire said frame to lift the boat from the water and lowering the entire said frame to lower the boat into the water;

a sprayer assembly having a plurality of spray nozzles;

means for communicably connecting said sprayer assembly to a source of water under pressure; and means for mounting said sprayer assembly to said frame such that said sprayer assembly is raised and lowered with said frame and said spray nozzles are directed at the hull of the boat supported on said frame, whereby water is introduced into said sprayer assembly and directed out through said spray nozzles to wash the hull of the boat.

2. The system of claim 1 in which said sprayer apparatus includes an elongate section of pipe and said spray nozzles comprise a series of holes formed in said pipe.

3. The system of claim 1 in which the sprayer apparatus includes a pair of generally parallel longitudinal legs and a transverse section interconnecting said legs, each of said legs including a plurality of spray nozzles.

4. The system of claim 1 in which said means for connecting include valve means for selectively restricting water under pressure from entering said sprayer apparatus.

5. The system of claim 3 in which said means for mounting include means for fastening said legs directly to said frame.

6. The system of claim 5 in which said means for fastening include at least one transverse bracket that interconnects each of said legs and the frame.

7. The system of claim 3 in which said means for mounting include means for securing said transverse section directly to said frame.

8. The system of claim 7 in which said means for securing include at least one longitudinal brace that interconnects said transverse section and the frame.

9. The system of claim 3 further including at least one guide device attached to and extending upwardly from said frame laterally outside of said leg segments, for guiding the boat onto the frame such that the hull is generally centered between said leg segments.

10. The system of claim 9 in which said guide device includes a generally cylindrical guide element that is rotatably mounted to a respective pole, which said pole is attached to and extends upwardly from the frame.

11. A system for lifting and washing a boat that is docked in a body of water, said system comprising:

a boat supporting frame disposed beneath the docked boat;

means for selectively raising the entire said frame to lift the boat from the water and lowering the entire said frame to lower the boat into the water;

a sprayer assembly having a plurality of spray nozzles;

means for communicably connecting said sprayer assembly to a source of water under pressure; and means for mounting said sprayer assembly to said frame such that said sprayer assembly is raised and lowered with said frame and said spray nozzles are directed at the hull of the boat supported on said frame, whereby water is introduced into said sprayer assembly and directed out through said spray nozzles to wash the hull of the boat, said sprayer apparatus including a pair of elongate, generally parallel pipe sections that extend along respective longitudinal sides of the hull and a transverse pipe section that interconnects said parallel pipe sections, said spray nozzles comprising a first series of holes formed in one of said parallel pipe sections and directed toward a first side of the boat hull and a second series of holes formed in the other of said parallel pipe sections and directed toward a second side of the boat hull.

12. A system for lifting and washing a double hulled boat docked in a body of water, said system comprising:

a frame that includes a pair of substantially parallel, elongate members for longitudinally supporting respective hulls of the boat and at least one transverse member interconnecting said elongate members, said frame being disposed beneath the docked boat;

means for selectively raising the entire said frame to lift the boat out of the water and lowering the entire said frame to lower the boat into the water;

a sprayer apparatus that includes a pair of sprayer assemblies, each assembly being associated with a respective one of the hulls of the boat and having a plurality of spray nozzles, each assembly further including a first leg that extends along a first longitudinal side of the associated hull, a second leg that extends along a second longitudinal side of the associated hull, and a transverse section that interconnects said legs, each of said legs including a plurality of said nozzles;

means for communicably connecting each said sprayer assembly to a source of water under pressure; and means for mounting each said sprayer apparatus to said frame such that said sprayer apparatus is raised and lowered with said frame and said spray nozzles are directed toward the hulls of the boat supported on said frame, whereby water is introduced into said sprayer assemblies and directed out through said spray nozzles to wash the hulls of the boat.

13. The system of claim 12 in which each sprayer assembly comprises an elongate segment of pipe and said spray nozzles comprise a series of holes formed in said pipes.

14. The system of claim 12 in which said means for connecting includes a pair of flexible hose segments that interconnect said water source with respective said sprayer assemblies.

15. The system of claim 12 in which said means for connecting include valve means for selectively restricting water under pressure from entering said sprayer assemblies.

16. The system of claim 12 in which said means for mounting include bracket means for fastening said legs of a first said assembly directly to one of the longitudinal members of the frame and for fastening said legs of a second said assembly directly to the other longitudinal member.

17. The system of claim 12 in which said means for mounting include longitudinal brace means for securing said transverse section of a first one of said assemblies directly to one of the longitudinal members of the frame and for securing said transverse section of a second one of said assemblies directly to the other of the longitudinal members.

18. The system of claim 12 further including a first group of at least one guide device attached to and extending upwardly from the frame laterally outside of said legs of a first one of said sprayer assemblies and a second group of at least one guide device attached to and extending upwardly from one frame laterally outside of said legs of said other sprayer assembly for guiding the boat onto the frame such that each hull is centered between a pair of leg segments of a respective said sprayer assembly.

19. The system of claim 18 in which each said guide device includes a pole that is mounted to said frame proximate a respective end of a transverse member of the frame.

20. The system of claim 19 in which each said guide device further includes a generally cylindrical float element is rotatably mounted to each said pole.

* * * * *